US012214847B2

(12) United States Patent
Jo et al.

(10) Patent No.: US 12,214,847 B2
(45) Date of Patent: Feb. 4, 2025

(54) POSITION CONTROL APPARATUS OF UNMANNED MARINE OBSERVATION APPARATUS AND CONTROLLING METHOD THEREOF

(71) Applicant: National Institute of Meteorological Sciences, Seogwipo-si (KR)

(72) Inventors: Hyeong Jun Jo, Jeju-si (KR); Kiryong Kang, Seogwipo-si (KR); Bo Yeong Ahn, Gangneung-si (KR); Chulkyu Lee, Seoul (KR)

(73) Assignee: NATIONAL INSTITUTE OF METEOROLOGICAL SCIENCES, Seogwipo-si (KR)

( * ) Notice: Subject to any disclaimer, the term of this patent is extended or adjusted under 35 U.S.C. 154(b) by 0 days.

(21) Appl. No.: 18/319,458

(22) Filed: May 17, 2023

(65) Prior Publication Data

US 2024/0149985 A1 May 9, 2024

(30) Foreign Application Priority Data

Nov. 3, 2022 (KR) ..... 10-2022-0145249

(51) Int. Cl.
*B63B 22/18* (2006.01)
*B63H 25/42* (2006.01)

(52) U.S. Cl.
CPC ..... *B63B 22/18* (2013.01); *B63H 25/42* (2013.01)

(58) Field of Classification Search
None
See application file for complete search history.

(56) References Cited

U.S. PATENT DOCUMENTS

2015/0344109 A1* 12/2015 Davoodi ..... G05D 1/0206 367/5
2015/0346726 A1* 12/2015 Davoodi ..... B63B 22/20 440/38
2016/0378107 A1* 12/2016 Morin ..... G05D 1/0044 701/2
2018/0321033 A1* 11/2018 Tauriac ..... B63B 22/18

FOREIGN PATENT DOCUMENTS

KR 20100095188 8/2010
KR 101231972 2/2013
KR 20180069308 A 6/2018
KR 102029039 10/2019
KR 102131377 7/2020

* cited by examiner

*Primary Examiner* — Adam D Tissot
*Assistant Examiner* — Garrett F Evans
(74) *Attorney, Agent, or Firm* — CANTOR COLBURN LLP

(57) ABSTRACT

Provided is a position control apparatus of an unmanned marine observation device, the position control apparatus including a main body part including a hollow portion into which the unmanned marine observation device is coupled, a movement part extending outward from the main body part and configured to move the unmanned marine observation device and the position control apparatus in the ocean, a GPS signal receiver configured to receive a GPS signal and produce position information on the basis of the GPS signal, and a controller configured to control an operation of the movement part on the basis of the GPS signal.

4 Claims, 8 Drawing Sheets

POSITION CONTROL APPARATUS OF UNMANNED MARINE OBSERVATION APPARATUS AND CONTROLLING METHOD THEREOF

BACKGROUND

Field

The present application relates to a position control apparatus of an unmanned marine observation apparatus and a control method thereof. More specifically, the present application relates to a position control apparatus of an unmanned marine observation apparatus and a control method thereof, in which the position control apparatus is mounted in the unmanned marine observation apparatus.

Description of the Related Art

Because typical marine observation causes great difficulty and enormous costs in comparison with atmospheric observation, the amount of marine observation data is very insufficient compared to the amount of atmospheric observation data. With the development of remote observation using artificial satellites, a lack of marine observation has been greatly solved accordingly. However, because the marine observation is limited to the surface layer, there is still a limitation in recognizing the internal structure of the ocean.

In addition, the unmanned marine observation device repeatedly observes a location at a predetermined depth according to a preset period.

However, because the unmanned marine observation device moves along the ocean current, it is impossible to consistently observe a specific point. In addition, because a buoy, which may perform static observation, performs observation on the surface layer, there is a limitation in exploring the interior of the ocean.

Meanwhile, a position control apparatus is coupled to the unmanned marine observation device in order to enable the unmanned marine observation device to consistently perform observation at a particular point without moving along the ocean current. Therefore, the unmanned marine observation device may perform continuous observation at the particular point without moving along the ocean current.

In addition, in comparison with the buoy that performs observation only on the surface layer part, the unmanned marine observation device may vertically observe parts including a surface layer part and a deep layer part at a particular point.

The background art of the present application is disclosed in Korean Patent No. 10-2029039.

SUMMARY

An object to be achieved by the present disclosure is to provide a position control apparatus of an unmanned marine observation apparatus and a control method thereof, which are capable of solving a problem in that the unmanned marine observation apparatus floats on a surface layer part or a deep layer part and moves along the ocean current, which makes it impossible to perform continuous observation at a particular point.

Further, another object to be achieved by the present disclosure is to provide a position control apparatus of an unmanned marine observation apparatus and a control method thereof, which are capable of obtaining static observation data by vertically observing parts including a surface layer part and a deep layer part at a particular point.

Further, still another object to be achieved by the present disclosure is to provide a position control apparatus of an unmanned marine observation apparatus and a control method thereof, which are capable of collecting static observation data without using a buoy.

However, technical problems to be solved by the exemplary embodiment of the present application are not limited to the aforementioned technical problem, and other technical problems may be present.

According to an aspect of the present disclosure, there is provided a position control apparatus of an unmanned marine observation device, the position control apparatus including: a main body part including a hollow portion into which the unmanned marine observation device is coupled: a movement part extending outward from the main body part and configured to move the unmanned marine observation device and the position control apparatus in the ocean: a GPS signal receiver configured to receive a GPS signal and produce position information on the basis of the GPS signal; and a controller configured to control an operation of the movement part on the basis of the GPS signal.

According to the embodiment of the present disclosure, the movement part may include one or more propellers configured to generate power for moving the unmanned marine observation device and the position control apparatus in the ocean.

According to the embodiment of the present disclosure, the controller may control operations of the one or more propellers on the basis of the GPS signal.

According to the embodiment of the present disclosure, the controller may control operations of some of the one or more propellers on the basis of information on a state of the unmanned marine observation device that moves along the ocean current in the ocean.

According to the embodiment of the present disclosure, the controller may be a device for controlling the operation of the propeller of the movement part, the controller may be provided in an outward direction of an outer surface of the main body part, and the controller may control the operation of the propeller of the movement part.

According to the embodiment of the present disclosure, the controller may control an operation of the movement part on the basis of information on a state of an external unmanned marine observation device different from the unmanned marine observation device.

According to the embodiment of the present disclosure, the movement part may be provided in an outward direction of the main body part and operate by receiving the GPS information from the GPS signal receiver, the movement part may control a movement of the position control apparatus of the unmanned marine observation device, and the movement part may operate to maintain a position of the unmanned marine observation device.

According to the embodiment of the present disclosure, the main body part may include a coupling part positioned along an inside of a hollow cylindrical shape of the main body part, the coupling part may be fastened while surrounding a periphery of a main body of the unmanned marine observation device, and the coupling part may connect the unmanned marine observation device and the position control apparatus of the unmanned marine observation device.

According to the embodiment of the present disclosure, the coupling part may have an embedded battery, the coupling part may receive the GPS information from the GPS signal receiver, and the coupling part may supply power for operating the propeller from the movement part.

According to the embodiment of the present disclosure, the GPS signal receiver may manage the GPS information while controlling a position of the unmanned marine observation device and transfer the GPS information to the controller, and the GPS signal receiver may transmit or receive a GPS signal while remaining on a surface layer part.

According to the embodiment of the present disclosure, the GPS signal receiver may determine whether to operate the propeller that operates on the basis of the transmitted or received GPS information, and the GPS signal receiver may transmit or receive the GPS information of a plurality of unmanned marine observation devices and determine a position on the basis of the GPS information.

Another object to be achieved by the present disclosure is to provide a method of controlling a position of an unmanned marine observation device including a main body part including a hollow portion into which the unmanned marine observation device is coupled, and a movement part extending outward from the main body part and configured to move the unmanned marine observation device and a position control apparatus in the ocean, the method including: receiving, by a GPS signal receiver, a GPS signal: creating position information on the basis of the GPS signal; and controlling an operation of the movement part on the basis of the GPS signal.

The technical solution is just illustrative but should not be interpreted as being intended to limit the present application. In addition to the above-mentioned exemplary embodiment, additional exemplary embodiments may be present in the drawings and the detailed description of the invention.

The technical solution of the present application provides the position control apparatus of the unmanned marine observation device, such that the unmanned marine observation device floating on the surface layer part and the deep layer part does not move along the ocean current. Therefore, the unmanned marine observation device performing the static observation without moving at the particular point.

According to the technical solution of the present application, the unmanned marine observation device may obtain vertical static observation data by observing the parts including the surface layer part and the deep layer part at the particular point and provide observation data, which makes it possible to improve the observation effect of the position control apparatus of the unmanned marine observation device.

The technical solution of the present application provides the effect of collecting the static observation data without a buoy, thereby maximizing the effect of the position control apparatus of the unmanned marine observation device.

However, the effects, which can be obtained by the present application, are not limited to the above-mentioned effects, and other effects may be present.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENT

Figure 1:
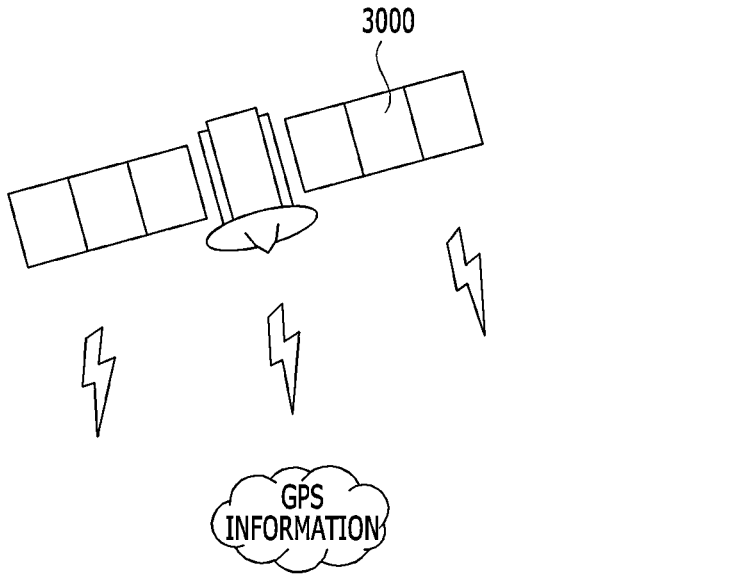
FIG. 1 is a view illustrating a schematic configuration of an unmanned marine observation system according to an embodiment of the present application.

Hereinafter, exemplary embodiments of the present application will be described in detail with reference to the accompanying drawings so that those with ordinary skill in the art to which the present application pertains may easily carry out the exemplary embodiments. However, the present application may be implemented in various different ways, and is not limited to the exemplary embodiments described herein. A part irrelevant to the description will be omitted in the drawings in order to clearly describe the present application, and similar constituent elements will be designated by similar reference numerals throughout the specification.

Throughout the specification of the present application, when one constituent element is referred to as being "connected to" another constituent element, one constituent element can be "directly connected to" the other constituent element, and one constituent element can also be "electrically connected to" or "indirectly connected to" the other element with other elements therebetween.

Throughout the specification of the present application, when one member is disposed "on", "at an upper side of", "at an upper end of", "below", "at a lower side of", or "at a lower end of" another member in the present specification of the present application, this includes not only a case where one member is brought into contact with another member, but also a case where still another member is present between the two members.

Throughout the specification of the present application, unless explicitly described to the contrary, the word "comprise" or "include" and variations, such as "comprises", "comprising", "includes" or "including", will be understood to imply the inclusion of stated constituent elements, not the exclusion of any other constituent elements.

Words of degree, such as "about", "substantially", and the like are used throughout the specification of the present application in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention. Throughout the specification of the present application, the term "step . . . " or "step of . . . " does not mean "step for . . . ".

In the present specification, the term 'unit,' 'part,' or 'means' includes a unit realized by hardware, a unit realized by software, and a unit realized by using both software and hardware. In addition, one unit may be realized by using two or more hardware, and two or more units may be realized by using one hardware.

In the present specification, some of the operations or functions, which are described as being performed by a terminal, an apparatus, or a device, may be instead performed by a server connected to the terminal, the apparatus, or the device. Likewise, some of the operations or functions, which are described as being performed by a server, may be performed by a terminal, an apparatus, or a device that is connected to the server. Hereinafter, an embodiment of the present disclosure will be described in detail with reference to the accompanying drawings.

FIG. 1 is a view illustrating a schematic configuration of an unmanned marine observation system according to an embodiment of the present application.

Referring to FIG. 1, the unmanned marine observation system may include an unmanned marine observation device 2000 and a position control apparatus 1000 of the unmanned marine observation device. However, the present disclosure is not limited thereto, and the unmanned marine observation system may further include additional components.

Figure 3:
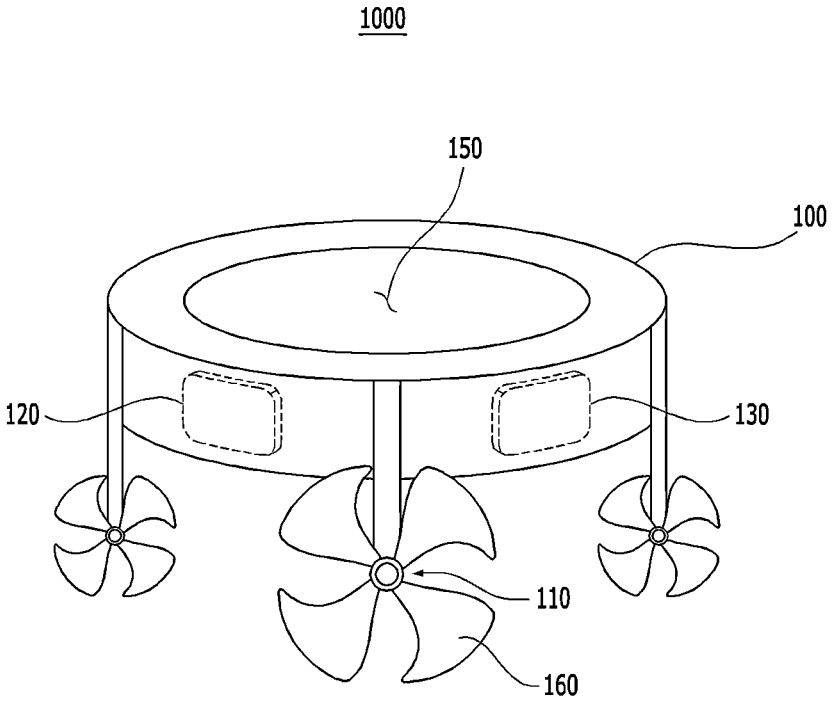
FIG. 3 is a view for explaining a shape of the position control apparatus of the unmanned marine observation device according to the embodiment of the present application.

The position control apparatus 1000 may have a shape including a hollow portion 150, as shown in FIG. 3. The unmanned marine observation device 2000 may be coupled to the interior of the hollow portion 150. The position control apparatus 1000 may be made of various materials such as plastic or metal.

In addition, the position control apparatus 1000 may create GPS information on the basis of a GPS signal transmitted from a GPS signal satellite 3000 in the state in which the position control apparatus 1000 is coupled to the unmanned marine observation device 2000. In addition, the position control apparatus 1000 may be connected to other external devices through a network. Examples of the other external devices may include another unmanned marine observation device 2100 or another position control apparatus 1100.

Figure 4:
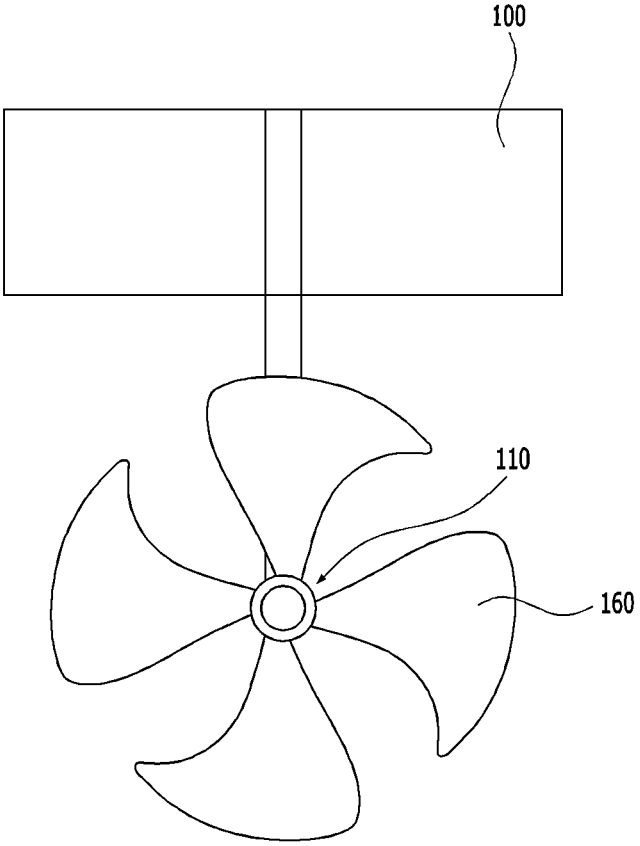
FIG. 4 is a view illustrating a controller according to the embodiment of the present application.
Figure 5:
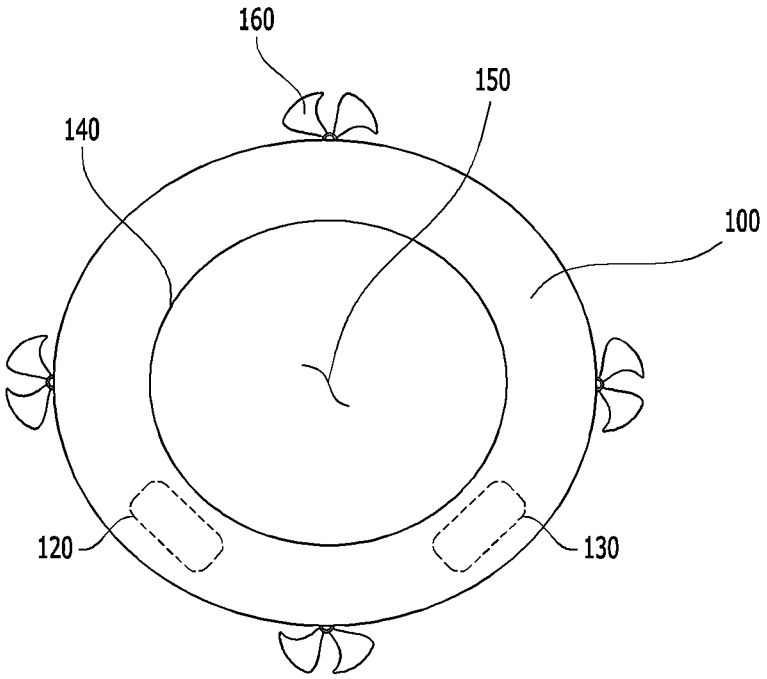
FIG. 5 is a top plan view illustrating the position control apparatus of the unmanned marine observation device according to the embodiment of the present application when viewed in one direction.

As shown in FIGS. 3, 4 and 5, the position control apparatus 1000 of the unmanned marine observation device according to the embodiment of the present application may include a main body part 100, a movement part 110, a GPS signal receiver 120, a controller 130, and a coupling part 140. In addition, as illustrated in FIG. 1, the position control apparatus 1000 includes an artificial satellite, a wired/wireless network communication, and GPS information, and the observation device may be configured on the basis of various pieces of information.

Figure 2:
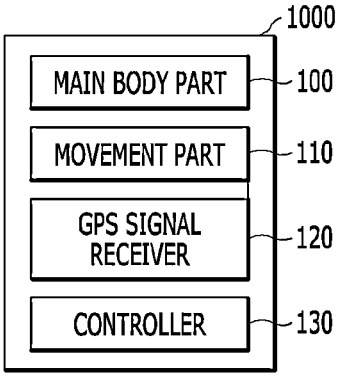
FIG. 2 is a block diagram schematically illustrating a position control apparatus of an unmanned marine observation device according to the embodiment of the present application.

FIG. 2 is a block diagram schematically illustrating the position control apparatus 1000 of the unmanned marine observation device 2000 according to the embodiment of the present application. Referring to FIG. 2, the position control apparatus 1000 may include the main body part 100, the movement part 110, the GPS signal receiver 120, and the controller 130.

However, the position control apparatus 1000 illustrated in FIG. 2 is one of the implemented examples of the present application. Those skilled in the art to which the embodiment of the present application pertains can understand that the position control apparatus 1000 may be modified in various forms on the basis of the constituent elements illustrated in FIG. 2. For example, the constituent elements and the functions provided in the constituent elements may be combined into a smaller number of constituent elements and/or divided into additional constituent elements.

The main body part 100 may include the hollow portion 150. In addition, the main body part 100 may be coupled to the unmanned marine observation device 2000.

In addition, the movement part 110 may extend outward from the main body part 100.

In addition, as illustrated in FIG. 5, the coupling parts 140 are positioned along an inside of the hollow portion 150 of the main body part 100. The coupling parts 140 may be fastened while surrounding a periphery of a main body of the observation device 2000.

The movement part 110 is provided in an outward direction of the main body part 100 and moves the unmanned marine observation device 2000 and the position control apparatus 1000 in the ocean.

The GPS signal receiver 120 may create position information on the basis of the GPS signal. The controller 130 may control an operation of the movement part 110 on the basis of the GPS signal.

FIG. 3 is a view for explaining a shape of the position control apparatus 1000 of the unmanned marine observation device according to the embodiment of the present application. FIG. 4 is a view illustrating the movement part 110 according to the embodiment of the present application.

Referring to FIGS. 3 and 4, the movement part 110 may not only extend outward from the main body part 100 but also extend inward. The movement part 110 may operate by receiving the GPS information from the GPS signal receiver 120.

In addition, the movement part 110 may control the movement of the position control apparatus 1000 and control the position of the unmanned marine observation device 2000, such that the observation may be performed even at a particular point at which the tidal current or the ocean current is strong.

In addition, the movement part 110 may include two or more movement parts 110, and each of the movement parts 110 may operate at least one propeller 160 to generate power. Therefore, the movement part 110 may move in all directions including forward/backward directions and leftward/rightward directions as well as the vertical direction deep in the ocean and in the surface of the ocean and can be held in position at a particular point.

In addition, the movement part 110 may operate by receiving the GPS information from the GPS signal receiver 120 and control the movement of the position control apparatus 1000 using the GPS information.

In addition, a direction, a position, and a state may be adjusted by the movement part 110, which makes it possible to improve efficiency in collecting the observation device 2000 that has completely performed the observation.

In addition, the movement part 110 may include the propeller 160 configured to generate power for moving the observation device 2000 in the ocean, and intensity of the power may be variously adjusted.

In addition, the movement part 110 may be provided with the propeller 160 and maintain the position thereof even in case where the tidal current or ocean current is strong, by controlling a speed of the propeller 160, such that the observation may be performed at a desired position.

In addition, the operation of the propeller 160 of the movement part 110 may maintain the position and the state of the observation device 2000 without being affected by marine and weather environments at a position at which the user's observation is required.

The movement part 110 may be provided in the form of the propeller 160 to actively control the position of the observation device 2000 in the ocean. However, the setting of the shape of the propeller is just an example for assisting in understanding the present application, and the present disclosure is not limited thereto. The propeller 160 may have various shapes such as a fixed pitch propeller, a variable pitch propeller, a constant speed propeller, a ducted propeller, a vertical axis propeller, and a contra-rotating propeller.

In addition, the propeller 160 includes one or more propellers 160. Therefore, even though some of the propellers are broken down, the position state may be maintained by the operations of the remaining propellers.

In addition, the propeller 160 of the movement part 110 may rotate clockwise or counterclockwise to move the position of the unmanned marine observation device 200 and maintain its position at a desired position.

Furthermore, speeds of the propellers 160 of the movement part 110 may be independently adjusted, and an overlap speed of the propellers of the movement part 110 may be adjusted as a whole.

In addition, the movement part 110 may rotate at various angles, which enables more efficient observation by the observation device 2000.

A material, which enables the movement part 110 to move flexibly against the ocean current and the tidal current in the ocean, is attached to the movement part 110, and the material is applied to all blades of the propeller 160.

The propeller of the movement part 110 operates to maintain the position in comparison with the preset static information in the related art.

Referring to FIGS. 3 and 5, the GPS signal receiver 120 is disposed between the main body part 100 and the coupling part 140.

The GPS signal receiver 120 may receive the GPS signal, create the position information on the basis of the GPS signal, and control the operation of the movement part 110.

The GPS signal receiver 120 may transfer the GPS information to the controller 130.

In addition, the operation of the GPS signal receiver 120 transmitting or receiving the GPS signal may be performed while the unmanned marine observation device remains on the surface layer part.

In addition, the GPS signal receiver 120 may determine whether the propeller 160 is operated on the basis of the transmitted or received GPS information. The GPS signal receiver 120 may determine the positions on the basis of the GPS information transmitted to or received from the plurality of unmanned marine observation devices 2000 and 2100, as illustrated in FIG. 1.

In addition, the user may perform monitoring in real time by using the GPS signal receiver 120 and recognize the position on the ocean floor without using a separate wired communication cable.

Further, a small computer embedded in the observation device 2000 may accurately provide the user with the information on the GPS signal receiver 120, observation data, information, and the like.

Furthermore, the observation device 2000 has an antenna that enables the user to recognize the position information. The antenna of the observation device 2000 may be used to provide the user with more accurate position information and the GPS information of the GPS signal receiver 120 of the position control apparatus 1000.

In addition, the GPS signal receiver 120 may transmit an observation result to the user through a communication network, such that whether to operate the propeller of the movement part 110 may be determined on the basis of the GPS signal, and the movement part 110 may be moved by setting the position in the sea area that is required to be observed by the user.

The GPS signal receiver 120 may transmit or receive various signals to or from the artificial satellite, the wired/wireless network, the Bluetooth, the Internet, and the like.

In addition, the GPS signal receiver 120 has a battery embedded in the coupling part 140, such that the GPS signal receiver 120 may be used by its own power source without using a separate power supply device.

In addition, the GPS signal receiver 120 may collect position information, such that the position of the position control apparatus 1000 may be easily recognized, and the monitoring may be performed in real time.

Further, even in case that the observation device 2000 is distant from the user, a position control apparatus 1100 attached to another external observation device 2100 may transmit the observation data to the user by means of various pieces of information including GPS information and state information. The another external observation device 2100 and the position control apparatus 110 attached thereto may be wirelessly and communicatively coupled to the observation device 2000.

The controller 130 may control the operations of the at least one propellers on the basis of the GPS signal and the information on the state of the observation device 2000.

In addition, referring to FIG. 3, the controller 130 may be provided in an outward direction of the main body part 100 and control the operation of the movement part 110 on the basis of information on a state of an outside of another external unmanned marine observation device 2100 different from the unmanned marine observation device 2000.

However, the setting of the shape of the controller 130 is just an example for assisting in understanding the present application, and the present disclosure is not limited thereto. The controller 130 may be provided in an inward direction of the main body part 100.

In addition, the controller 130 may control the operation of the movement part 110 to maintain a desired position without being swept by the ocean current during the observation on the ocean.

In addition, the controller 130 may independently control the constituent elements of the position control apparatus 1000 or control the functions as a whole.

In addition, the controller 130 may control the operation and perform the observation on a static point by appropriately maintaining a distance between the controller 130 and another external observation device 2100.

In addition, a buoy, which is observed on the surface layer part, may be used to vertically observe the static point from the surface layer part to the deep layer part at the particular point under the control of the controller 130.

In addition, the controller 130 may detect information on a marine environment observed when a control signal is inputted when a signal related to the position control apparatus 1000 is inputted. The controller 130 may control the position control apparatus 1000 on the basis of the signal inputted by the user and the information on the marine environment.

When the observation device 2000 performs observation, the controller 130 performs observation by controlling the state of the position control apparatus 1000. The controller 130 may maintain the vertical and horizontal positions, without changing the vertical and horizontal positions, on the basis of the setting of the GPS signal receiver 120 in accordance with the user's setting so that observation device 2000 does not move along the ocean current.

In addition, the controller 130 may not only independently control the propellers 160 of the movement part 110 one by one but also control all the propellers 160 of the movement part 110.

Figure 6:
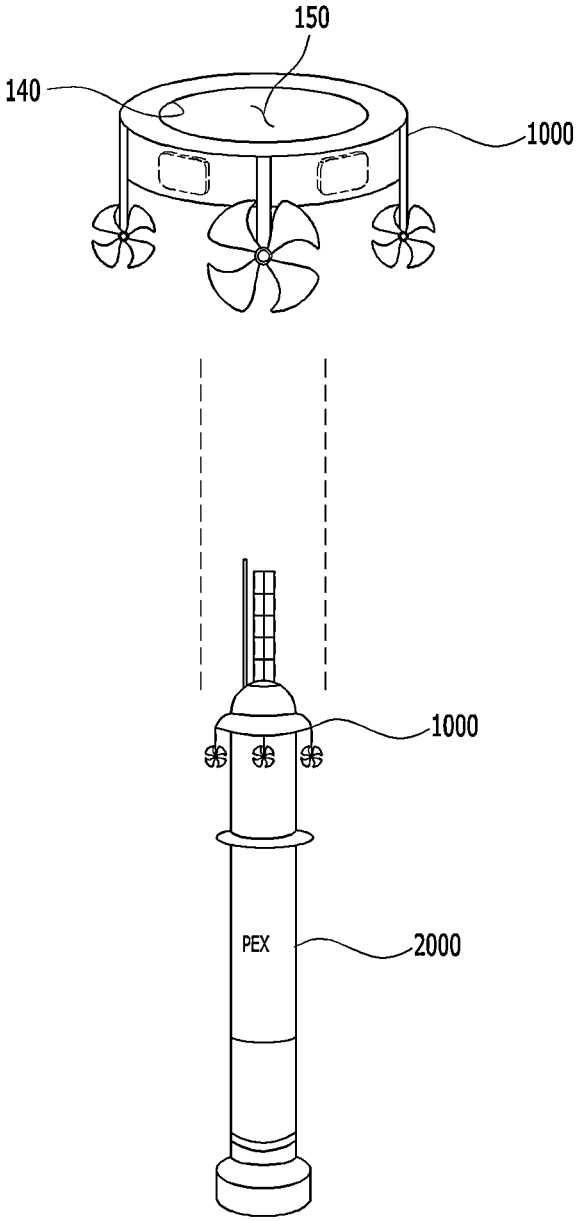
FIG. 6 is an exemplified view for explaining a state in which the position control apparatus of the unmanned marine observation device according to the embodiment of the present application is attached.

FIG. 5 is a top plan view illustrating the position control apparatus 1000 when viewed in one direction, and FIG. 6 is a view for explaining a state in which the position control apparatus 1000 is attached to the observation device 2000.

Referring to FIGS. 5 and 6, the coupling part 140 may be positioned along the inside of the cylindrical hollow portion 150 of the main body part 100.

In addition, FIG. 6 is a view illustrating in detail a state in which the coupling part 140 is coupled to the observation device 2000.

In addition, the coupling part 140 may be fastened while surrounding the periphery of the main body of the unmanned marine observation device 2000 and connect the observation device 2000 and the position control apparatus 1000.

In addition, the coupling part 140 may have an embedded battery. The coupling part 140 may receive the GPS information from the GPS signal receiver 120 and supply power for operating the propeller 160 from the movement part 110.

In addition, the coupling part 140 may be adjusted and coupled to various unmanned marine observation devices 2000 without another auxiliary device.

Further, the adjustment of the coupling part 140 makes it easy to attach or detach the coupling part 140 to or from the observation device 2000, which makes it easy to perform maintenance by replacing the devices.

Figure 7:
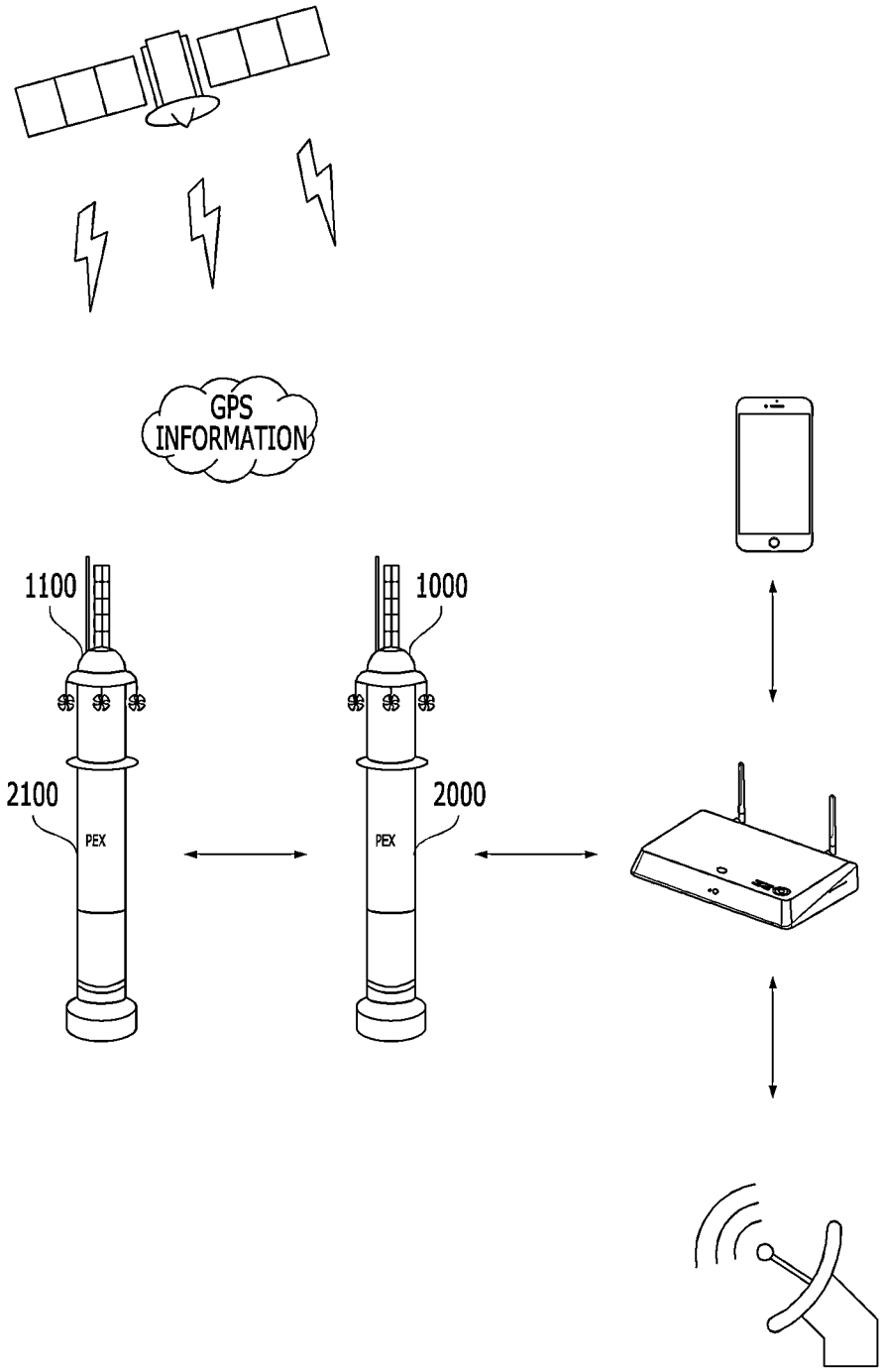
FIG. 7 is a view for explaining an operation of the unmanned marine observation device and an operation of the position control apparatus of the unmanned marine observation device according to the embodiment of the present application.
Figure 8:
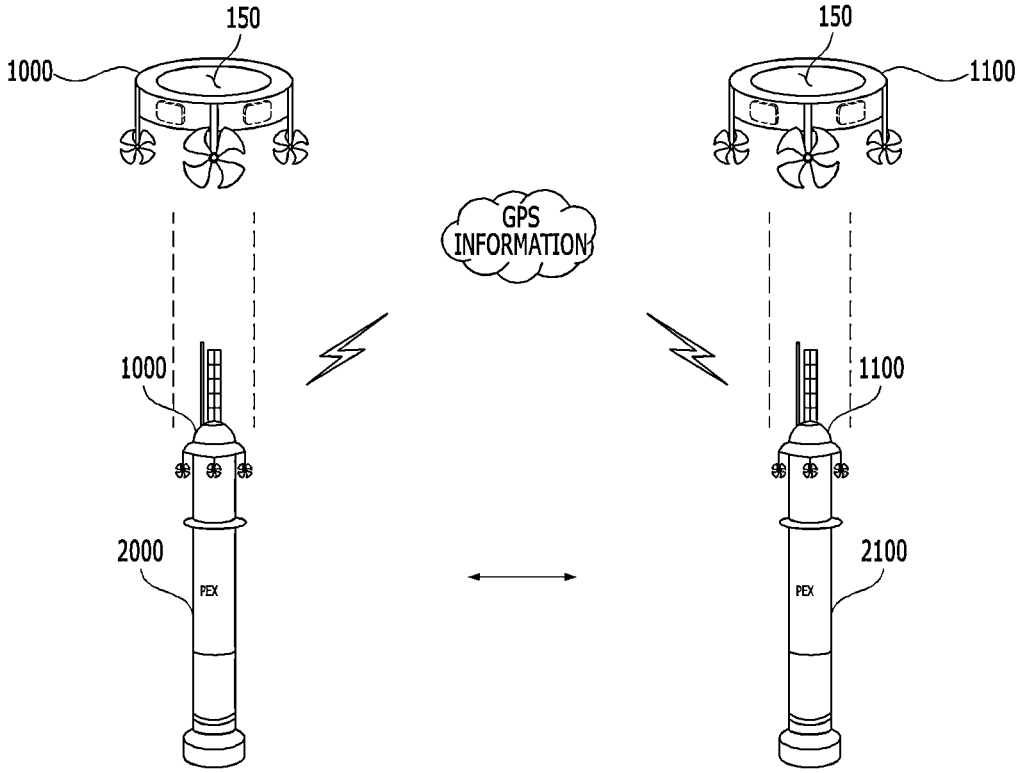
FIG. 8 is a view illustrating different unmanned marine observation devices to which the position control apparatus of the unmanned marine observation device is attached.

FIGS. 7 and 8 is a view for explaining the operation of the observation device 2000 and the operation of the position control apparatus 1000, and different observation devices 2100 to which the position control apparatus 1100 is attached.

Referring to FIG. 7, the position control apparatus 1000, 1100 may be controlled by the artificial satellite, the wired/wireless network communication, the terminal, and the like. In addition, referring to FIG. 8, the operations of the different observation devices 2000, 2100, to which the position control apparatus 1000, 1100 is attached, may be controlled on the basis of the GPS information and the information on the outside state.

Referring to FIG. 7, in the ocean, the position control apparatus 1000 may collect various pieces of information on the observation device 2000, which is moved or maintained, and control the different observation devices 2100.

In addition, the position control apparatus 1000 attached to the observation device 2000 may transfer or receive various pieces of information to or from the user. For example, information including GPS information and information on the interior of the ocean, the water level, the ocean current, the tidal current, and the seawater temperature may be transferred to the user.

Further, a distance of the observation device 2000 to which the position control apparatus 1000 is attached may be maintained on the basis of the user's setting even at a long distance on the basis of various pieces of information. The observation devices 2000 may be independently controlled. Alternatively, the plurality of different observation devices 2100 to which the position control apparatus 1100 is attached may establish a system provided in the form of a wireless communication network. The observation device 2000 or the plurality of observation devices 2000, 2100 may be controlled by the system.

Furthermore, the observation device 2000 in the related art is equipped with the battery therein and designed to produce observation data every ten days while repeatedly moving upward and downward while adjusting buoyancy. The position control apparatus 1000 may be used to enable the observation device 2000 to move downward and upward by the user's remote adjustment even though the position control apparatus 1000 in the related art does not move every ten days.

In addition, the observation device 2000 on the surface layer part takes 8 to 12 hours to transmit data. The position control apparatus 1000 may reduce the amount of time and transmit more accurate observation data and information to the user.

In addition, when the position control apparatus 1000 is used to observe the ocean, the observation device 2000 is less affected by various factors in the ocean, such that an average lifespan of the observation device 2000 may be increased.

In addition, referring to FIGS. 7 and 8, the control method may be implemented in the form of program instructions executable by means of various means and then written in a computer-readable medium. The computer-readable medium may include program instructions, data files, data structures, or the like, in a stand-alone form or in a combination thereof. The program instructions recorded in the medium may be specially designed and configured for the present disclosure or may be known and available to those skilled in computer software. Examples of the computer-readable recording medium may include magnetic media, such as a hard disk, a floppy disk and a magnetic tape, optical media, such as CD-ROM and DVD, magneto-optical media, such as a floptical disk, and hardware devices, such as ROM, RAM and flash memory, which are specifically configured to store and run program instructions. Examples of the program instructions may include machine codes made by, for example, a compiler, as well as high-language codes that may be executed by an electronic data processing device, for example, a computer, by using an interpreter. The above-mentioned hardware devices may be configured to operate as one or more software modules in order to perform the operation of the present disclosure, and the opposite is also possible.

In this case, examples of the network communication performed between the position control apparatus 1000 and a user terminal (not illustrated) may include, but not limited to, wired/wireless communication such as the 3rd generation partnership project (3GPP) network, the long term evolution (LTE) network, the world interoperability for microwave access (WTMAX) network, the Internet), the local area network (LAN), the wireless local area network (wireless LAN), the wide area network (WAN), the personal area network (PAN), the Bluetooth network, the near field communication (NFC) network, the satellite broadcast network, the analog broadcast network, and the digital multimedia broadcasting (DMB) network.

In addition, the user terminals may include all types of wired/wireless communication devices such as the personal communication system (PCS), the global system for mobile communication (GSM), the personal digital cellular (PDC), the personal handy phone system (PHS), the personal digital assistant (PDA), the international mobile telecommunication (IMT)-2000, the code division multiple access (CDMA)-2000, the w-code division multiple access (W-CDMA), the wireless broadband Internet (Wibro) terminal, the smartphone, the smart pad, the tablet PC, the notebook, the wearable device, and the desktop PC.

With the above-mentioned structure, the operation of the position control apparatus 1000 may be controlled on the basis of the control signal obtained from the user's terminal, which may improve convenience for the user.

In addition, a method of controlling the position control apparatus 1000 of the unmanned marine observation device may also be implemented in the form of a computer program or application stored in a recording medium and executed by a computer.

Figure 9:
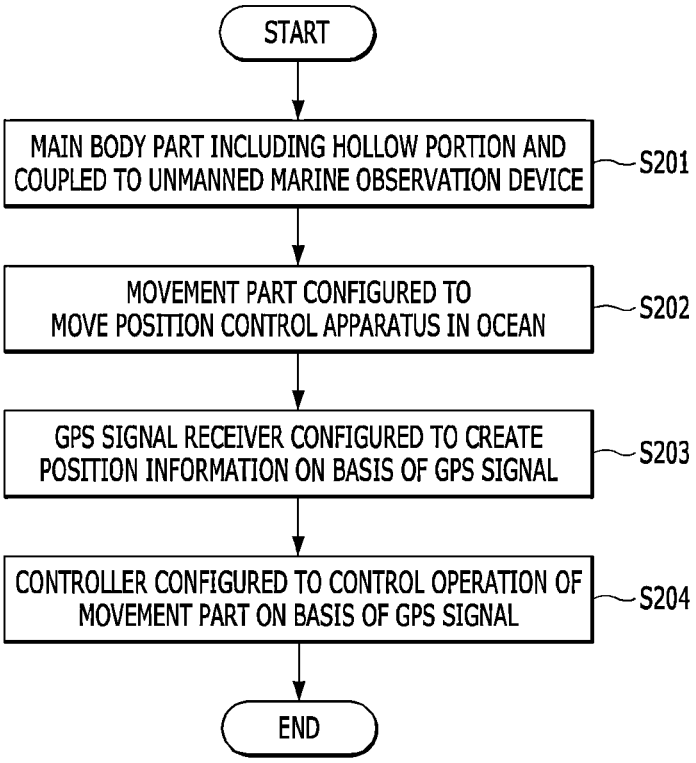
FIG. 9 is a flowchart of the position control apparatus of the unmanned marine observation device.

FIG. 9 according to the embodiment of the present application is a flowchart of the position control apparatus 1000 of the unmanned marine observation device.

The position control apparatus 1000 includes: the main body part 100 including the hollow portion into which the unmanned marine observation device 2000 is coupled (S201):

the movement part 110 extending outward from the main body part 100 and configured to move in the ocean (S202);

the GPS signal receiver 120 configured to produce position information on the basis of the GPS signal (S203); and the controller 130 configured to control the operation of the movement part 110 on the basis of the GPS signal (S204).

However, this process is just an example for assisting in understanding the present application, and the present disclosure is not limited thereto. The flow of the position control apparatus 1000 may be combined with various constituent elements or divided into additional constituent elements.

It will be appreciated that the embodiments of the present application have been described above for purposes of illustration, and those skilled in the art may understand that the present application may be easily modified in other specific forms without changing the technical spirit or the essential features of the present application. Therefore, it should be understood that the above-described embodiments are illustrative in all aspects and do not limit the present disclosure. For example, each component described as a single type may be carried out in a distributed manner. Likewise, components described as a distributed type can be carried out in a combined type.

The scope of the present application is represented by the claims to be described below rather than the detailed description, and it should be interpreted that the meaning and scope of the claims and all the changes or modified forms derived from the equivalent concepts thereto fall within the scope of the present application.

What is claimed is:

1. A position control apparatus of an unmanned marine observation device, the position control apparatus comprising:

a first position control apparatus and a second position control apparatus, wherein the first position control apparatus comprises:

a first main body part comprising a first hollow portion into which a first unmanned marine observation device is coupled;

a first movement part extending outward from the first main body part and configured to move the first unmanned marine observation device in the ocean, wherein the first movement part comprises a plurality of first propellers configured to generate power for moving the first unmanned marine observation device to a first pre-determined position and maintaining the first unmanned marine observation device at the pre-determined position;

a first GPS signal receiver configured to receive a first GPS signal and produce position information on the basis of the first GPS signal; and a first controller configured to control an operation of the first movement part on the basis of the first GPS signal, wherein the second position control devise comprises:

a second main body part comprising a second hollow portion into which a second unmanned marine observation device is coupled;

a second movement part extending outward from the second main body part and configured to move the second unmanned marine observation device in the ocean, wherein the second movement part comprises a plurality of second propellers configured to generate power for moving the second unmanned marine observation device to a second pre-determined position and maintaining the second unmanned marine observation device at the second pre-determined position;

a second GPS signal receiver configured to receive a second GPS signal and produce position information on the basis of the second GPS signal; and a second controller configured to control an operation of the second movement part on the basis of the second GPS signal, wherein the first position control apparatus and the second position control apparatus are wirelessly and communicatively coupled to each other, and wherein the first controller and the second controller are configured to operate the first movement part and the second movement part to maintain a pre-determined distance between the first unmanned marine observation device and the second unmanned observation device.

2. The position control apparatus of claim 1, wherein the first GPS signal receiver is further configured to receive a signal from a user terminal or an artificial satellite, wherein the first controller is further configured to control an operation of the first movement part on the basis of the signal, and wherein the second controller is further configured to control an operation of the second movement part to maintain the pre-determined distance between the first unmanned marine observation device and the second unmanned observation device on the basis of the signal.

3. The position control apparatus of claim 1, wherein the first main body part comprises a coupling part positioned along an inside of a first hollow portion of the first main body part, wherein the coupling part is fastened while surrounding a periphery of a main body of the first unmanned marine observation device, and wherein the coupling part connects the first unmanned marine observation device and the first position control apparatus.

4. The position control apparatus of claim 3, wherein the coupling part has an embedded battery, wherein the coupling part receives the first GPS signal from the first GPS signal receiver, and wherein the coupling part supplies power for operating the first propellers of the first movement part.

* * * * *